US007326131B2

(12) United States Patent
Sajima et al.

(10) Patent No.: US 7,326,131 B2
(45) Date of Patent: Feb. 5, 2008

(54) GOLF BALL

(75) Inventors: Takahiro Sajima, Kobe (JP); Keiji Ohama, Kobe (JP)

(73) Assignee: SRI Sports Limited, Chuo-Ku Kobe (JP)

( * ) Notice: Subject to any disclaimer, the term of this patent is extended or adjusted under 35 U.S.C. 154(b) by 0 days.

(21) Appl. No.: 10/819,304

(22) Filed: Apr. 7, 2004

(65) Prior Publication Data

US 2004/0204267 A1 Oct. 14, 2004

(30) Foreign Application Priority Data

Apr. 8, 2003 (JP) ..... 2003-104332

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS

| | | | | |
|---|---|---|---|---|
| 4,813,677 A | | 3/1989 | Oka et al. | |
| 5,733,205 A | * | 3/1998 | Higuchi et al. | 473/376 |
| 5,735,757 A | | 4/1998 | Moriyama | |
| 5,743,814 A | * | 4/1998 | Endo | 473/374 |
| 5,795,247 A | * | 8/1998 | Yokota et al. | 473/374 |
| 5,800,287 A | * | 9/1998 | Yokota et al. | 473/372 |
| 5,957,787 A | * | 9/1999 | Hwang | 473/379 |
| 6,494,794 B1 | * | 12/2002 | Ohama | 473/371 |
| 6,569,038 B2 | * | 5/2003 | Sullivan | 473/383 |
| 6,599,204 B2 | * | 7/2003 | Kasashima et al. | 473/383 |
| 7,041,013 B2 | * | 5/2006 | Ohama et al. | 473/384 |
| 2001/0036872 A1 | * | 11/2001 | Kasashima et al. | 473/378 |

FOREIGN PATENT DOCUMENTS

JP 2-68077 A 3/1990

* cited by examiner

*Primary Examiner*—Raeann Trimiew
(74) *Attorney, Agent, or Firm*—Birch, Stewart, Kolasch & Birch, LLP

(57) ABSTRACT

A golf ball conforming a core, a cover and numerous dimples formed on the surface of the cover. The thickness of the cover is equal to or less than 1.4 mm. The Shore D hardness of the cover is equal to or less than 53. The dimple 4 has an inclined face, a circular flat face, an annular groove and a round flat face. The surface area s1 is calculated by summing up the surface area of the inclined face, the surface area of the circular flat face, the surface area of the annular groove and the surface area of the round flat face 9. The ratio (S1/S2) between a summation S1 of surface areas s1 of all the dimples, and a summation S2 of the areas s2 of the regions cut away by the dimples on the phantom spherical face, is equal to or greater than 1.03. The difference (Cc−Cb) between the amount of compressive deformation Cb of the golf ball and the amount of compressive deformation Cc of the core is equal to or less than 0.20 mm. The amount of compressive deformation Cc of the core is equal to or less than 3.00 mm.

8 Claims, 7 Drawing Sheets

GOLF BALL

This application claims priority on Patent Application No. 2003-104332 filed in Japan on Apr. 8, 2003.

BACKGROUND OF THE INVENTION

1. Field of the Invention

The present invention relates to golf balls. More particularly, the present invention relates to golf balls having a core and a cover, with dimples being formed on the cover.

2. Description of the Related Art

General golf balls that are commercially available in the market have a core and a cover. The core is composed of a solid rubber, and the cover is composed of a resin composition. There also exist golf balls having a core composed of a center and a mid layer. The mid layer may be composed of a solid rubber, or alternatively, may be composed of a resin composition.

There are numerous dimples formed on the surface of the cover. The role of the dimples involves causing turbulent flow separation by disrupting the air flow around the golf ball during flight (hereinafter, referred to as "dimple effect"). By causing the turbulent flow separation, a separating point of air from the golf ball shifts backwards leading to the reduction of a drag coefficient (Cd). The turbulent flow separation promotes the differential between upper and lower separating points of the golf ball that result from the backspin, thereby enhancing the lifting force that acts upon the golf ball. Flight distance of the golf ball is prolonged on behalf of the reduced drag and enhanced lift force. Aerodynamically, excellent dimples promote turbulent flow separation. In other words, aerodynamically, excellent dimples may provide a better air flow.

During the flight of a golf ball, the air flows along the dimples. The shape of the dimple is one of the important factors that determine the aerodynamic characteristics of the golf ball. In an attempt to improve the dimple effect, a variety of proposals have been made in connection with the cross sectional shape of the dimple. JP-A No. 2-68077 discloses dimples having a protrusion at the center. U.S. Pat. No. 5,735,757 discloses dimples having two curved faces with different curvatures.

The volume of the dimples is also one of the important factors that determine aerodynamic characteristics of a golf ball. U.S. Pat. No. 4,813,677 discloses a golf ball having a dimple volume defined as an index which falls within a predetermined range.

What are most demanded for a golf ball by golf players are flight performances. There is still an opportunity for improving dimples to enhance flight performance. Accordingly, an object of the present invention is to provide a golf ball that achieves a great flight distance.

SUMMARY OF THE INVENTION

The golf ball according to the present invention has a core, a cover and numerous dimples formed on the surface of the cover. According to the present golf ball, the thickness of the cover is equal to or less than 1.4 mm, and shore D hardness of the cover is equal to or less than 53. Also, the ratio (S1/S2) between a summation S1 of surface areas s1 of the dimples, and a summation S2 of the areas s2 of the regions cut away by the dimples on the phantom spherical face is equal to or greater than 1.03.

The present golf ball has a greater ratio (S1/S2) in comparison with conventional golf balls and accordingly the drag is reduced, and a high spin rate is achieved on behalf of the soft cover. The golf ball of the present invention achieves an optimal trajectory based on the synergistic effect resulting from a small amount of drag and a high spin rate. The present golf ball is also excellent in flight performance.

Preferably, the difference (cove Cc−golf ball Cb) between the amount of compressive deformation Cb of the golf ball and the amount of compressive deformation Cc of the core is equal to or less than 0.20 mm, and the amount of compressive deformation Cc of the core is equal to or less than 3.00 mm. Thus, the golf ball achieves a great lift force. In the light of its flight performance, it is preferred that the total volume V of the dimples is 400 $mm^3$ or greater and 800 $mm^3$ or less.

The dimple preferably has a recessed part at the center thereof. The dimple may have an annular groove. The recessed part or the annular groove is responsible for the balance of the ratio (S1/S2) to be equal to or greater than 1.03 for an and optimum total volume V.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4 (*b*) is a cross-sectional view of the golf ball shown in FIG. 4 (*a*);

FIG. 5 (*b*) is a cross-sectional view of the golf ball shown in FIG. 5 (*a*);

FIG. 6 (*b*) is a cross-sectional view of the golf ball shown in FIG. 6 (*a*)

DESCRIPTION OF THE PREFERRED EMBODIMENTS

The present invention is hereinafter described in detail with appropriate references to the accompanying drawing according to the preferred embodiments of the present invention.

Figure 1:
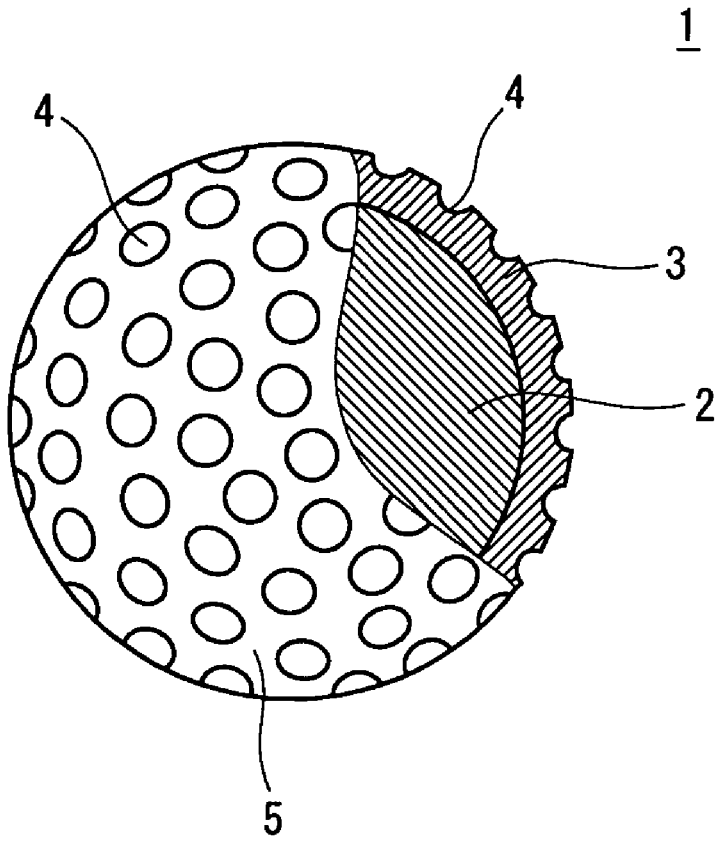
FIG. 1 is a schematic cross-sectional view illustrating the golf ball according to one embodiment of the present invention.

A golf ball 1 depicted in FIG. 1 has a spherical core 2 and a cover 3. Numerous dimples 4 are formed on the surface of the cover 3. Of the surface of the cover 3, parts other than the dimples 4 are lands 5. The golf ball 1 has a paint layer and a mark layer on the external side of the cover 3, although these layers are not shown in the Figure. The golf ball 1 generally has a diameter of from 40 mm to 45 mm, and in particular, from 42 mm to 44 mm. In light of the reduction of the air resistance in the range to comply with a rule defined by United States Golf Association (USGA), the diameter is particularly preferably 42.67 mm or greater and 42.85 mm or less. The weight of the golf ball 1 is generally 40 g or greater and 50 g or less, and particularly 44 g or greater and 47 g or less. In light of the elevation of inertia in the range to comply with a rule defined by United States Golf Association, the weight is particularly preferably 45.00 g or greater and 45.93 g or less.

The cover 3 referred to herein means an outermost layer except for a paint layer and a mark layer. There exist golf balls referred to as having a cover with a two-layered structure, however, in this instance, the outer layer corresponds to the cover 3 herein.

Figure 2:
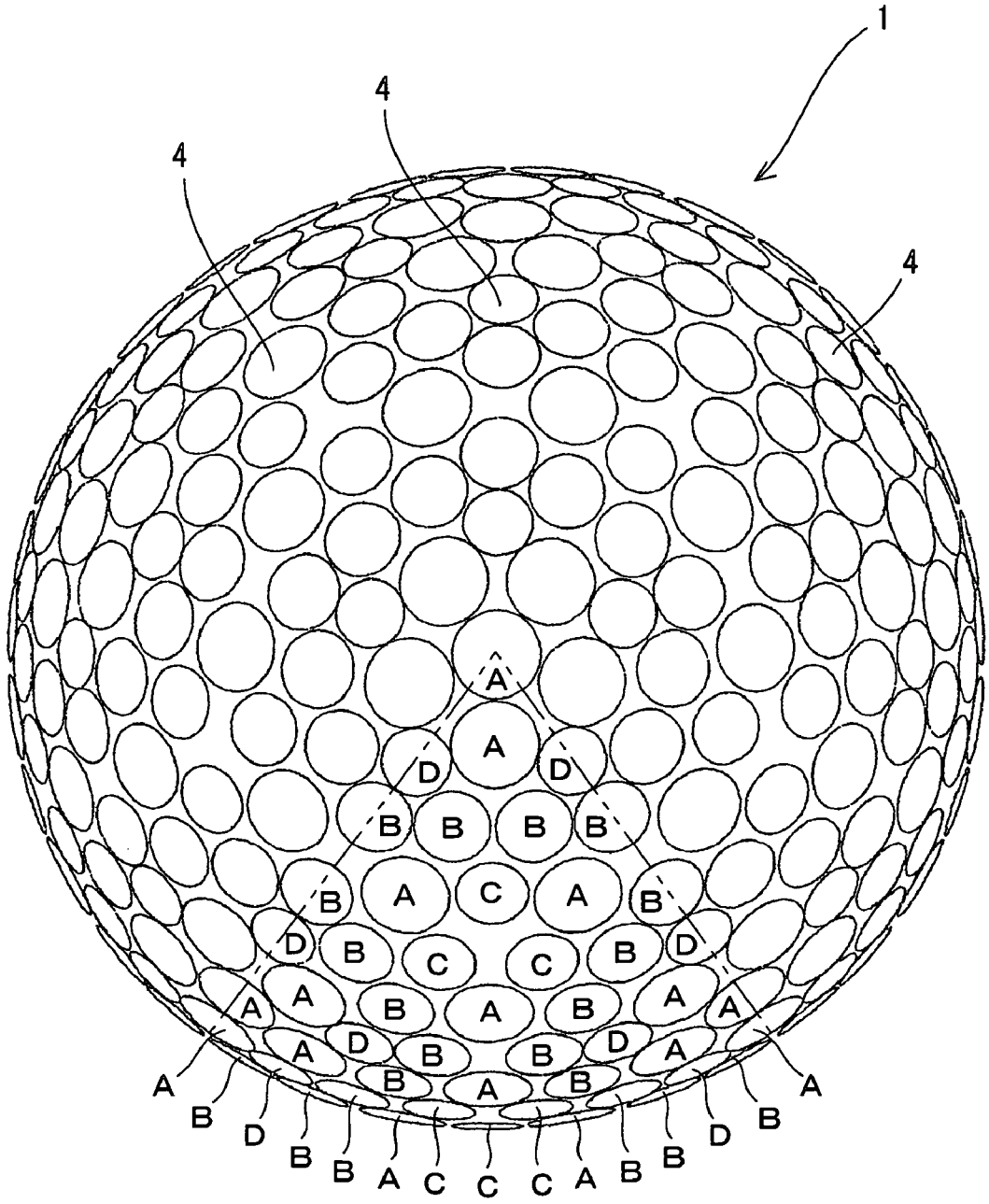
FIG. 2 is an enlarged plan view illustrating the golf ball shown in FIG. 1.
Figure 3:
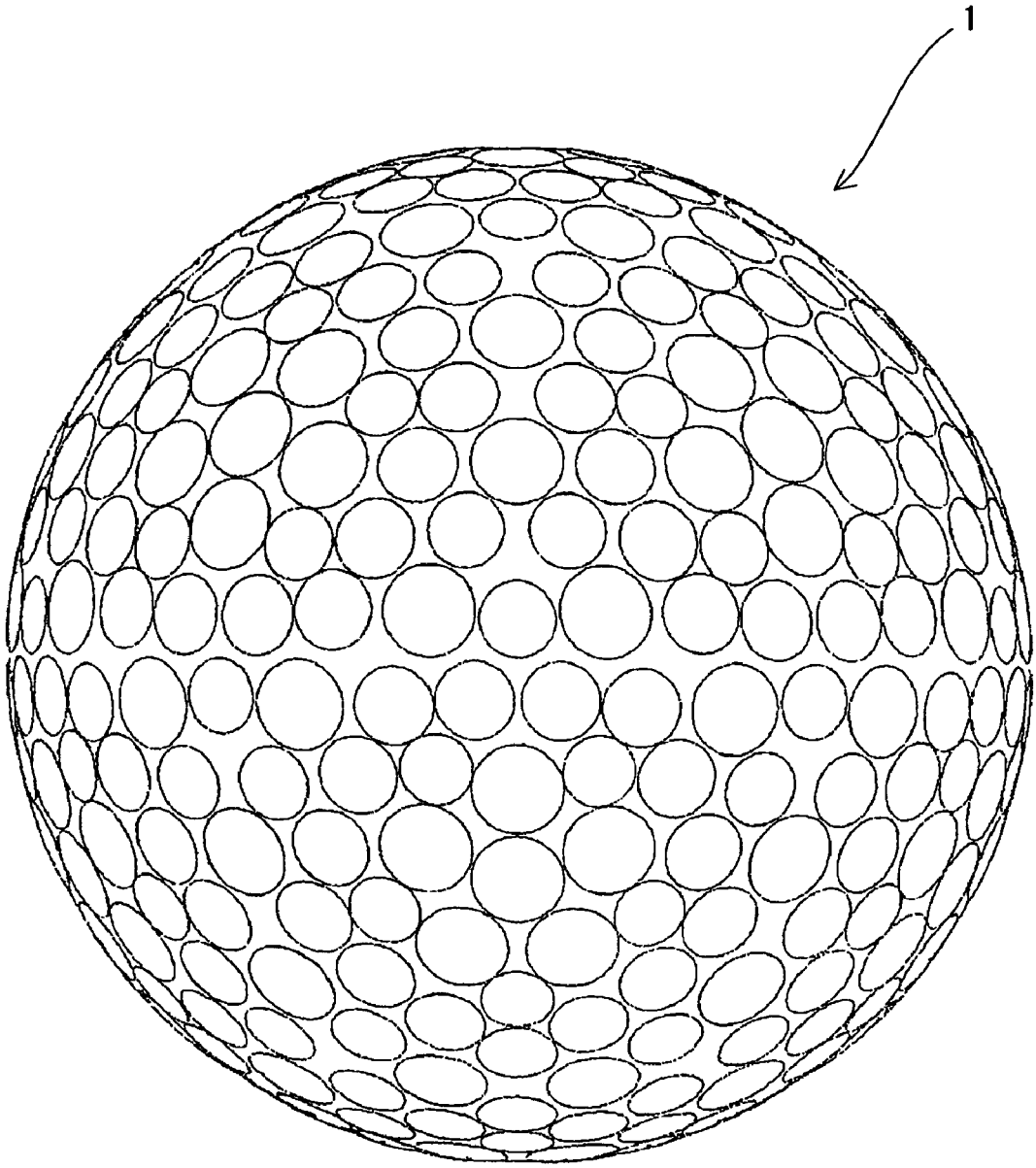
FIG. 3 is a front view illustrating the golf ball shown in FIG. 2.

FIG. 2 is an enlarged plan view illustrating the golf ball 1 shown in FIG. 1; and FIG. 3 is a front view of the same. The golf ball 1 has A dimples having a plane shape of circular configuration with a diameter of 4.00 mm; B dimples has a plane shape of circular configuration with a diameter of 3.45 mm; C dimples have a plane shape of circular configuration with a diameter of 3.30 mm; and D dimples have a plane shape of circular configuration with a diameter of 3.15 mm. The term "plane shape" referred to herein means the shape of the contour line which is a boundary between the land 5 and the dimple 4, when it is viewed at infinity. The number of the A dimples is 132; the number of the B dimples is 180; the number of the C dimples is 60; and the number of the D dimples is 60. The total dimple number N of the golf ball 1 is 432. In FIG. 2, four types of dimples 4 are illustrated by reference symbols A to D with respect to one unit given by compartmentalizing the surface of the golf ball 1 into 10 equivalent units.

Figure 4:
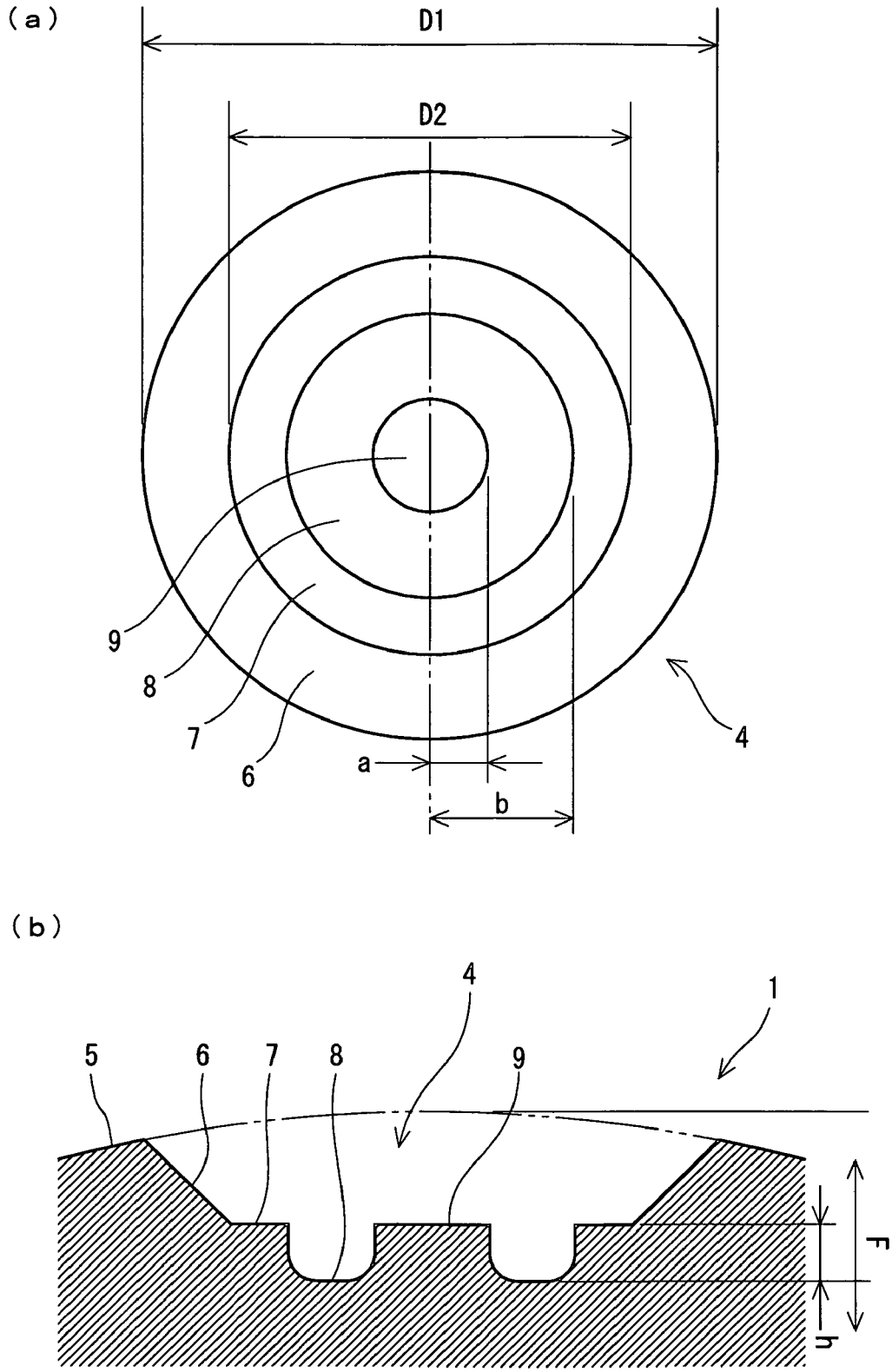
FIG. 4 (*a*) is an enlarged view illustrating a part of the golf ball shown in FIG. 1.

FIG. 4 (*a*) is an enlarged view illustrating a part of the golf ball 1 shown in FIG. 1; and FIG. 4 (*b*) is a cross-sectional view derived from FIG. 4 (*a*). In FIG. 4 (*b*), a cross-section is illustrated which is provided by a plane that passes the center of gravity of the plane shape of the dimple 4 and the center of the golf ball 1. As shown in FIG. 4, the dimple 4 comprises an inclined face 6, a circular flat face 7, an annular groove 8 and a round flat face 9. The surface area s1 is calculated by summing up the surface area of the inclined face 6, the surface area of the circular flat face 7, the surface area of the annular groove 8 and the surface area of the round flat face 9. The surface area S1 is obtained by summing up the surface areas s1 of all the dimples. As is clear from FIG. 4 (*b*), the cross-sectional shape of the annular groove 8 is "U" shaped. The dimple 4 may have an annular groove of different cross sectional shapes, e.g., "V" shaped, half round, circular arc or the like.

What is indicated by the chain double-dashed line in FIG. 4 (*b*) is a region that is cut away by the dimple 4 from the phantom spherical face. The area of this region is s2. Area S2 is obtained by summing up the areas s2 for all the dimples. The phantom spherical face means a spherical face which may be present when it is postulated that there are no existing dimples 4.

According to dimple 4, the surface area s1 is increased due to the annular grooves 8. During the flight of the golf ball 1, the air flows along the dimples 4. It is speculated that the dimple 4, having a greater surface area s1, disturbs the air flow more efficiently. By providing a large number of dimples 4 having a great surface area s1, the drag of the golf ball 1 can be reduced. By providing a large number of dimples 4 having a greater surface area s1, the ratio (S1/S2) is increased. In other words, the ratio (S1/S2) is an index that correlates to the drag. The golf ball 1 having the ratio (S1/S2) of equal to or greater than 1.03 is excellent in its flight performance. The ratio (S1/S2) is more preferably equal to or greater than 1.06, and particularly preferably equal to or greater than 1.09. The ratio (S1/S2) is preferably equal to or less than 1.50. When the ratio (S1/S2) is too great, an expensive mold is required, and also, the formation of the paint layer involves difficulties.

By providing a large number of dimples 4 having the ratio (s1/s2) of equal to or greater than 1.03, a golf ball 1 having the ratio (S1/S2) of equal to or greater than 1.03 can be obtained. The proportion of the number of dimples 4, which have a ratio (S1/S2) of equal to or greater than 1.03, to the total dimple number N is preferably equal to or greater than 50%, more preferably equal to or greater than 65%, and particularly preferably equal to or greater than 80%. This proportion is ideally 100%.

It is preferred that the surface area s1 is 8.2 $mm^2$ or greater and 38.7 $mm^2$ or less. It is preferred that total surface area S1 is 4130 $mm^2$ or greater and 7740 $mm^2$ or less. The surface area s2 is usually 8.0 $mm^2$ or greater and 25.8 $mm^2$ or less. Total surface area S2 is usually 4010 $mm^2$ or greater and 5160 $mm^2$ or less.

The "total volume V" referred to herein means a summation of the volume v of all the dimples. The "volume v of the dimple" referred to herein means the volume of the space surrounded by a phantom spherical surface and the dimple 4. The total volume V in the present invention is set to be 400 $mm^3$ or greater and 800 $mm^3$ or less. When the total volume V is less than the above range, a hopping trajectory may be provided. In this respect, the total volume V is more preferably equal to or greater than 420 $mm^3$, and particularly preferably equal to or greater than 440 $mm^3$. When the total volume V is beyond the above range, a drop in the trajectory may be provided. In this respect, the total volume V is more preferably equal to or less than 760 $mm^3$, and particularly preferably equal to or less than 720 $mm^3$. Through the formation of a large number of dimples 4 having an annular groove 8, the golf ball 1 can be obtained having a total volume V within a proper range, with the ratio (S1/S2) being equal to or greater than 1.03.

What is indicated by the double-sided arrowhead D1 in FIG. 4 is the diameter of the dimple 4. This diameter D1 is the distance between both contact points when common tangent lines are depicted at both sides of the dimple 4. A contour line is formed of many contact points. The diameter is generally set to be 2.0 mm or greater and 7.0 mm or less, still more preferably 2.2 mm or greater and 6.8 mm or less, and particularly 2.4 mm or greater and 6.6 mm or less.

Instead of the circular dimples 4, or together with the circular dimples 4, non-circular dimples may be also formed. Specific examples of the non-circular dimple include elliptical dimples, oval dimples, egg-shaped dimples and polygonal dimples. When a non-circular dimple is formed, the contour length x of the same is usually set to be 6 mm or greater and 25 mm or less, and particularly, set to be 9 mm or greater and 22 mm or less. It is preferred that multiple kinds or types of dimples having the different shapes or sizes with each other are formed.

It is preferred that the highest part of the dimple 4 does not protrude out of the phantom spherical face. The release of the air which has flowed into the dimple 4 is thereby suppressed. Ideally, the highest part of the dimple 4 is positioned on the contour line.

Surface area occupation ratio Y of the golf ball 1 is preferably 70% or greater and 90% or less. When the surface area occupation ratio Y is less than the above range, the dimple effect may be insufficient. In this respect, the surface area occupation ratio Y is more preferably equal to or greater than 72%, and particularly preferably equal to or greater than 75%. When the surface area occupation ratio Y is beyond the above range, the land parts 5 are easily scuffed. In this respect, the surface area occupation ratio Y is more preferably equal to or less than 88%, and particularly preferably equal to or less than 87%. The term "surface area occupation ratio Y" referred to herein means a proportion of the total area S2 occupied in the surface area of the phantom spherical face.

What is indicated by the double-sided arrowhead F in FIG. 4 is the depth of the dimple 4. This depth F is the distance between the deepest part in the dimple 4 and the phantom spherical face. The depth F is preferably 0.10 mm or greater and 2.00 mm or less. When the depth F is less than the above range, a hopping trajectory may be provided. In this respect, the depth F is more preferably equal to or greater than 0.12 mm, and particularly preferably equal to or greater than 0.14 mm. When the depth F is beyond the above range, a dropping trajectory may be experienced. In this respect, the depth F is more preferably equal to or less than 1.95 mm, and particularly preferably equal to or less than 1.90 mm.

Total number N of the dimples 4 is preferably 200 or greater and 500 or less. When the total number N is less than the above range, there is the possibility that the fundamental feature of the golf ball, which is a substantially spherical body, may not be sustained. In this respect, the total number N is more preferably equal to or greater than 230, and particularly preferably equal to or greater than 250. When the total number N is beyond the above range, the drag coefficient (Cd) may become so large that the flight distance may become insufficient. In this respect, the total number N is more preferably equal to or less than 470, and particularly preferably equal to or less than 450.

Dimple specifications such as surface area s1, area s2, volume v, diameter D1, depth F and the like are determined by actual measurement of the golf ball 1. The golf ball 1 generally has a paint layer on its surface, and thus accurate measurement of the size may involve difficulties due to the influence of the paint layer. When the actual measurement of the golf ball 1 having a paint layer creates difficulties, the golf ball prior to the painting may be subjected to actual measurements.

The shore D hardness of the cover 3 is set to be equal to or less than 53. In other words, the cover is soft. The soft cover 3 results in a great spin rate. According to the findings obtained by the present inventors, a golf ball 1 having the ratio (S1/S2) equal to or greater than 1.03 exhibits a sufficiently reduced drag. However, a sufficient lift force is not provided. A high spin rate is achieved by setting the shore D hardness of the cover 3 to be equal to or less than 53. Thus, an elevated spin rate compensates for an insufficient lift force, thereby optimizing the trajectory. The golf ball 1 achieves a great travel distance due to the synergistic effect exerted by both of the dimples 4, having a great surface area, and the soft cover 3. A great spin rate is also responsible for a control performance of the golf ball. In light of the spin rate, the shore D hardness of the cover 3 is preferably equal to or less than 50, and particularly preferably equal to or less than 45. In light of the resilience performance of the golf ball 1, the shore D hardness of the cover 3 is preferably equal to or greater than 25, and particularly, preferably equal to or greater than 30. The shore D hardness is measured in accordance with a standard of "ASTM-D 2240-68", with a Shore D type spring hardness scale. For the measurement, a slab is used which consists of the identical resin composition to that for the cover 3.

The thickness of the cover 3 is set to be equal to or less than 1.4 mm. In other words, the cover 3 is thin. As described above, a soft material for the cover is used for the purpose of elevating the lift force of the golf ball 1. Such soft materials for the cover are inferior in resilience performances. Making the cover 3 thinner suppresses the deterioration of the resilience performance of the golf ball 1. In light of the resilience performance, the thickness of the cover 3 is preferably equal to or less than 1.2 mm, and particularly preferably equal to or less than 1.0 mm. Because the formation of the cover 3 that is too thin is difficult, the thickness is preferably equal to or greater than 0.3 mm, and particularly preferably equal to or greater than 0.5 mm.

Illustrative examples of the base polymer for use in the cover 3 include thermoplastic polyurethane elastomers, ionomer resins, thermoplastic polyolefin elastomers, thermoplastic polyester elastomers, thermoplastic polystyrene elastomers and thermoplastic polyamide elastomers. In light of the spin rate, it is preferred that a thermoplastic polyurethane elastomer is employed as the predominant component for the cover 3. When another polymer is used in combination with a thermoplastic polyurethane elastomer, the proportion of the thermoplastic polyurethane elastomer occupied in the entire base polymer is preferably equal to or greater than 50% by weight, and particularly preferably equal to or greater than 70% by weight.

An appropriate amount of various additives may be blended to the cover as needed. Specific examples of the additive include coloring agents such as titanium dioxide, fillers such as barium sulfate, dispersants, antioxidants, ultraviolet absorbents, light stabilizers, fluorescent agents, fluorescent brightening agents and the like. For the purpose of adjusting the specific gravity, the cover 3 may be blended with powder of a highly dense metal. Specific examples of the highly dense metal include tungsten and molybdenum.

The difference (Cc−Cb) between the amount of compressive deformation Cb of the golf ball 1 and the amount of compressive deformation Cc of the core 2 is preferably equal to or less than 0.20 mm. Through setting the difference (Cc−Cb) to be equal to or less than 0.20 mm, the spin rate of the golf ball 1 is elevated, thereby achieving a great lift force. In light of the spin rate, the difference (Cc−Cb) is preferably equal to or less than 0.15 mm, and particularly preferably equal to or less than 0.10 mm. In light of the resilience performance of the golf ball 1, the difference (Cc−Cb) is preferably equal to or greater than −0.20 mm, and particularly preferably equal to or greater than −0.15 mm.

Upon the measurement of the amount of compressive deformation, a spherical body (golf ball 1 or core 2) which is the subject to be measured, is first placed on a hard plate made of metal. Next, a cylinder made of metal is made to descend gradually toward the spherical body. Accordingly, the spherical body, which is disposed between the bottom face of this cylinder and the hard plate, is deformed. The migration distance of the cylinder, starting from the state in which an initial load of 98 N is applied to the spherical body up to the state in which a final load of 1274 N is applied thereto, is the amount of compressive deformation.

It is preferred that the amount of compressive deformation Cc of the core 2 is equal to or less than 3.00 mm. In other words, the core 2 is preferably hard to some extent. As described above, a soft material for the cover is used in the golf ball 1 for the purpose of elevating the lift force. Such soft materials for the cover are inferior in resilience performances. Making the core 2 harder will facilitate maintaining the resilience performance of the golf ball. In this respect, the amount of compressive deformation Cc is preferably equal to or less than 2.80 mm, more preferably equal to or less than 2.50 mm, still more preferably equal to or less than 2.45 mm, and further more preferably equal to or less than 2.40 mm. In light of the feel at impact of the golf ball 1, the amount of compressive deformation Cc is preferably equal to or greater than 2.00 mm.

The amount of compressive deformation Cb of the golf ball 1 is preferably equal to or less than 3.00 mm. When the amount of compressive deformation Cb is beyond the above range, the resilience performance of the golf ball 1 may be insufficient. In this respect, the amount of compressive deformation Cb is preferably equal to or less than 2.80 mm, more preferably equal to or less than 2.60 mm, and further particularly preferably equal to or less than 2.40 mm. In light of the feel at impact of the golf ball 1, the amount of compressive deformation Cb is preferably equal to or greater than 1.80 mm, and particularly, preferably equal to or greater than 2.00 mm.

The core 2 is obtained through crosslinking of a rubber composition. Illustrative examples of a base rubber for use in the rubber composition include polybutadienes, polyisoprenes, styrene-butadiene copolymers, ethylene-propylene-diene copolymers and natural rubbers. Two or more kinds of these rubbers may be used in combination. In light of the resilience performance, polybutadienes are preferred. In the case where another rubber is used in combination with a polybutadiene, to employ a polybutadiene as a predominant component is preferred. Specifically, it is preferred that the proportion of polybutadiene occupied in the entire base rubber is equal to or greater than 50% by weight, and particularly equal to or greater than 80% by weight. Polybutadienes having a percentage of cis-1,4 bond of equal to or greater than 40%, and particularly equal to or greater than 80% are particularly preferred.

For crosslinking of the core 2, a co-crosslinking agent is usually used. Preferable co-crosslinking agent in light of the resilience performance is a monovalent or bivalent metal salt of an α,β-unsaturated carboxylic acid having 2 to 8 carbon atoms. Specific examples of the preferable co-crosslinking agent include zinc acrylate, magnesium acrylate, zinc methacrylate and magnesium methacrylate. Zinc acrylate and zinc methacrylate are particularly preferred on the grounds that a high resilience performance is achieved.

As a co-crosslinking agent, an α,β-unsaturated carboxylic acid having 2 to 8 carbon atoms, and a metal oxide may be blended. Both components react in the rubber composition to give a salt. This salt is responsible for a co-crosslinking reaction. Examples of the preferable α,β-unsaturated carboxylic acid include acrylic acids and methacrylic acids. Examples of the preferable metal oxide include zinc oxide and magnesium oxide.

The amount of the co-crosslinking agent to be blended is preferably 15 parts by weight or greater and 50 parts by weight or less per 100 parts by weight of the base rubber. When the amount to be blended is less than the above range, the resilience performance of the golf ball 1 may become insufficient. In this respect, the amount to be blended is more preferably equal to or greater than 20 parts by weight. When the amount to be blended is beyond the above range, the feel at impact of the golf ball 1 may become insufficient. In this respect, the amount to be blended is more preferably equal to or less than 45 parts by weight, and particularly preferably equal to or less than 40 parts by weight.

In the rubber composition for use in the core 2, an organic peroxide may be preferably blended together with the co-crosslinking agent. The organic peroxide is responsible for a crosslinking reaction. By blending the organic peroxide, the resilience performance of the golf ball 1 may be improved. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

The amount of the organic peroxide to be blended is preferably 0.1 part by weight or greater and 3.0 parts by weight or less per 100 parts by weight of the base rubber. When the amount to be blended is less than the above range, the resilience performance of the golf ball 1 may become insufficient. In this respect, the amount to be blended is more preferably equal to or greater than 0.3 part by weight, and particularly preferably equal to or greater than 0.5 part by weight. When the amount to be blended is beyond the above range, the feel at impact of the golf ball 1 may become hard. In this respect, the amount to be blended is particularly preferably equal to or less than 2.5 parts by weight.

A filler may be blended to the core 2 for the purpose of adjusting specific gravity and the like. Illustrative examples of the suitable filler include zinc oxide, barium sulfate, calcium carbonate and magnesium carbonate. Powder consisting of highly dense metal may be blended as a filler. Specific examples of the highly dense metal include tungsten and molybdenum. The amount of the filler to be blended is determined ad libitum so that the intended specific gravity of the core 2 can be accomplished. Particularly preferable filler is zinc oxide. Zinc oxide serves not only as a mere agent for adjusting specific gravity but also as a crosslinking activator. Various kinds of additives such as sulfur, an anti-aging agent, a coloring agent, a plasticizer, a dispersant and the like may be blended at an appropriate amount to the core 2 as needed. The core 2 may be further blended with crosslinked rubber powder or synthetic resin powder.

General crosslinking temperature of the core 2 is 140° C. or greater and 180° C. or less, and particularly 160° C. or greater and 180° C. or less. General crosslinking time period of the core 2 is 10 minutes or longer and 60 minutes or less.

The core may be composed of a center and a mid layer covering over this center. In this instance, a similar rubber composition to the rubber composition for use in the core 2 as described above is used for the center. For the mid layer, a resin composition or a rubber composition is used. When a resin composition is used for the mid layer, illustrative examples of the base polymer therefor include ionomer resins, thermoplastic polyurethane elastomers, thermoplastic polyolefin elastomers, thermoplastic polyester elastomers, thermoplastic polystyrene elastomers and thermoplastic polyamide elastomers. In light of the resilience performance of the golf ball 1, ionomer resins are particularly preferred. A filler and other additives which are similar to those for use in the aforementioned cover 3 may be added to the resin composition for the mid layer.

A base rubber, a co-crosslinking agent, an organic peroxide and a filler which are similar to those for use in the aforementioned core 2 may be used when the mid layer consists of a rubber composition. The amount of the co-crosslinking agent to be blended in the mid layer may be 15 parts by weight or greater and 40 parts by weight or less, still more 20 parts by weight or greater and 40 parts by weight or less, and particularly 20 parts by weight or greater and 35 parts by weight or less per 100 parts by weight of the base rubber. The amount of the organic peroxide to be blended in the mid layer is 0.1 part by weight or greater and 6.0 parts by weight or less, still more 0.5 part by weight or greater and 5.0 parts by weight or less, and particularly 0.5 part by weight or greater and 4.0 parts by weight or less per 100 parts by weight of the base rubber.

Figure 5:
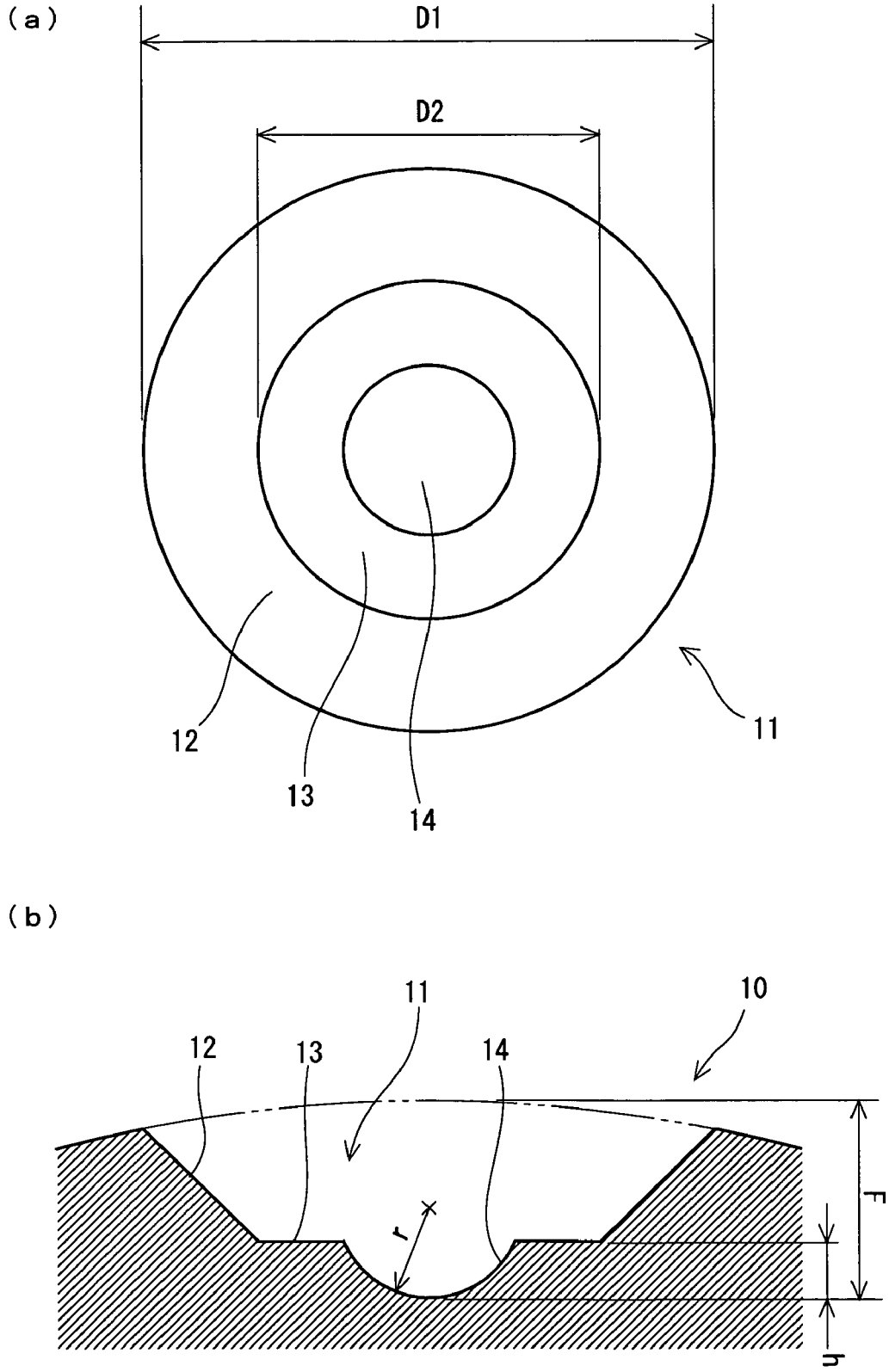
FIG. 5 (*a*) is a plan view illustrating a part of a golf ball according to another embodiment of the present invention.

FIG. 5 (*a*) is a plan view illustrating a part of a golf ball 10 according to another embodiment of the present invention; and FIG. 5 (*b*) is a cross-sectional view of the same. In FIG. 5 (*b*), a cross-section is illustrated which is provided by a plane that passes the center of gravity of the plane shape of the dimple 11 and the center of the golf ball 10. The golf ball 10 also has a core and a cover which are similar to those of the golf ball 1 depicted in FIG. 1. As shown in the FIG. 5, the dimple 11 comprises an inclined face 12, a circular flat face 13 and a recessed part 14. The surface area s1 is calculated by summing up the surface area of the inclined face 12, the surface area of the circular flat face 13, and the surface area of the recessed part 14. The surface area S1 is obtained by summing up the surface areas s1 of all the dimples. As is clear from FIG. 5 (*b*), the recessed part 14 is positioned at the center of the dimple 11. The cross-sectional shape of the recessed part 14 is in a circular arc. In other words, the recessed part 14 is a portion of aspherical face. The dimple may have a recessed part that is conical, truncated conical, pyramidal, truncated pyramidal, cylindrical, prismatic or the like.

What is indicated by a chain double-dashed line in FIG. 5 (*b*) is a region that was cut away by the dimple 11 from the phantom spherical face. The area of this region is s2. Total area S2 is obtained by summing up the areas s2 for all the dimples.

According to this dimple 11, the surface area s1 thereof is increased due to the recessed part 14. Also in this golf ball 10, the ratio (S1/S2) is equal to or greater than 1.03. The golf ball 10 is excellent in the flight performance. The ratio (S1/S2) is more preferably equal to or greater than 1.06, and particularly preferably equal to or greater than 1.09. The ratio (S1/S2) is preferably equal to or less than 1.50.

Also in this golf ball 10, the total volume V is set to be 400 $mm^3$ or greater and 800 $mm^3$ or less. The total volume V is more preferably equal to or greater than 420 $mm^3$, and particularly, preferably equal to or greater than 440 $mm^3$. The total volume V is more preferably equal to or less than 760 $mm^3$, and particularly, preferably equal to or less than 720 $mm^3$. Through the formation of a large number of dimples 11 having the recessed part 14, the golf ball 10 can be obtained having a total volume V within a proper range, with the ratio (S1/S2) being equal to or greater than 1.03. Also in this golf ball 10, the surface area occupation ratio Y is preferably 70% or greater and 90% or less. The surface area occupation ratio Y is more preferably equal to or greater than 72%, and particularly, preferably equal to or greater than 75%. The surface area occupation ratio Y is more preferably equal to or less than 88%, and particularly, preferably equal to or less than 87%. Also in this golf ball 10, the total number N of the dimples 11 is preferably 200 or greater and 500 or less. The total number N is more preferably equal to or greater than 230, and particularly, preferably equal to or greater than 250. The total number N is more preferably equal to or less than 470, and particularly, preferably equal to or less than 450.

Shore D hardness of the cover of this golf ball 10 is set to be equal to or less than 53. Shore D hardness of the cover is preferably equal to or less than 50, and particularly preferably equal to or less than 45. Shore D hardness of the cover is preferably equal to or greater than 25, and particularly, preferably equal to or greater than 30. The thickness of the cover is set to be equal to or less than 1.4 mm. The thickness of the cover is preferably equal to or less than 1.2 mm, and particularly, preferably equal to or less than 1.0 mm. The thickness of the cover is preferably equal to or greater than 0.3 mm, and particularly, preferably equal to or greater than 0.5 mm.

Difference (Cc−Cb) between the amount of compressive deformation Cb of this golf ball 10 and the amount of compressive deformation Cc of the core is preferably equal to or less than 0.20 mm. The difference (Cc−Cb) is preferably equal to or less than 0.15 mm, and particularly, preferably equal to or less than 0.10 mm. The difference (Cc−Cb) is preferably equal to or greater than −0.20 mm, and particularly, preferably equal to or greater than −0.15 mm.

The amount of compressive deformation Cc of the core is preferably equal to or less than 3.00 mm. The amount of compressive deformation Cc is preferably equal to or less than 2.80 mm, more preferably equal to or less than 2.50 mm, still more preferably equal to or less than 2.45 mm, and further more preferably equal to or less than 2.40 mm. The amount of compressive deformation Cc is preferably equal to or greater than 2.00 mm.

The amount of compressive deformation Cb of this golf ball 10 is preferably equal to or less than 3.00 mm. The amount of compressive deformation Cb is preferably equal to or less than 2.80 mm, more preferably equal to or less than 2.60 mm, and further more preferably equal to or less than 2.40 mm. The amount of compressive deformation Cb is preferably equal to or greater than 1.80 mm, and particularly, preferably equal to or greater than 2.00 mm.

Figure 6:
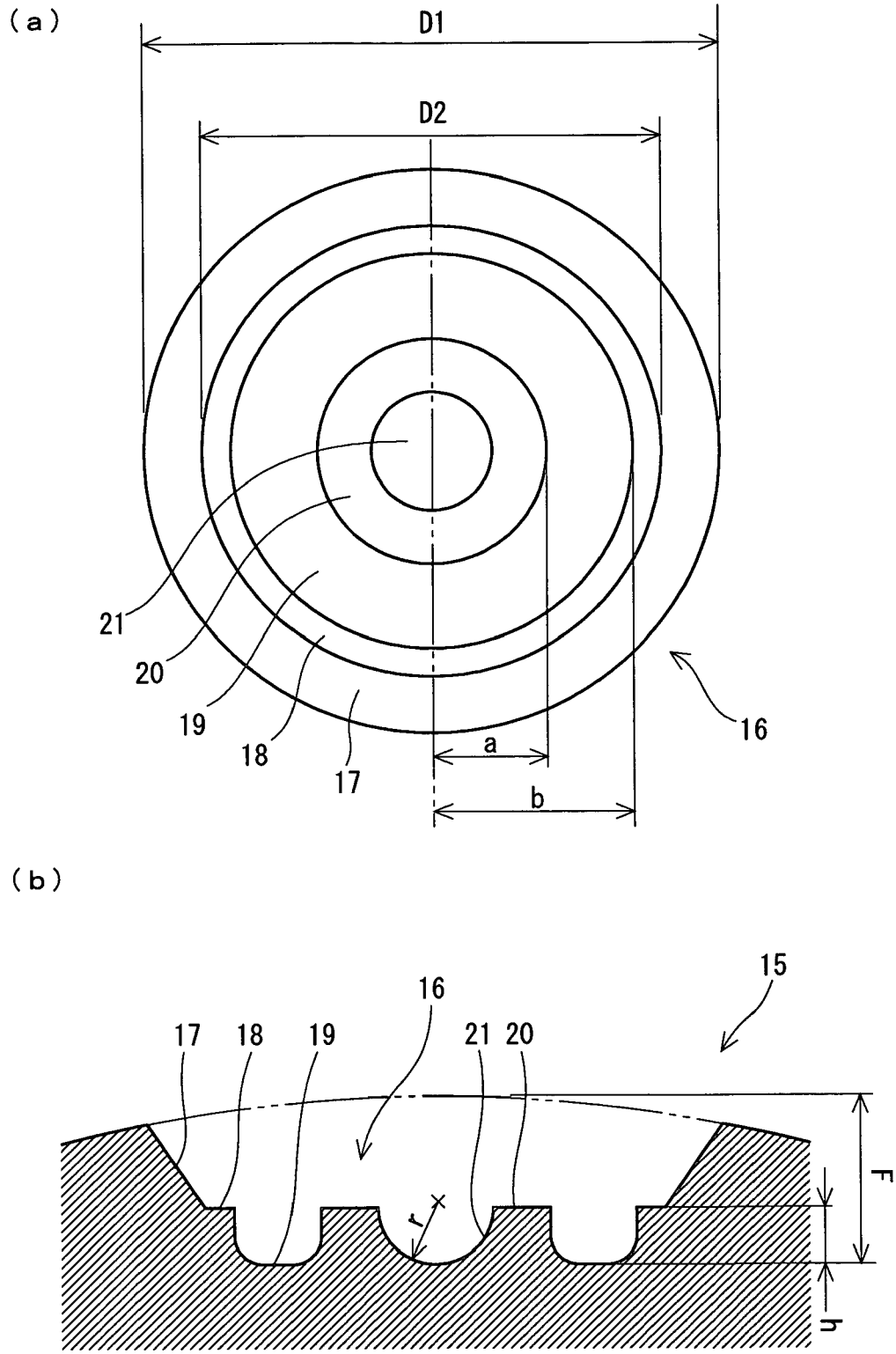
FIG. 6 (*a*) is a plan view illustrating a part of a golf ball according to yet another embodiment of the present invention.

FIG. 6 (*a*) is a plan view illustrating a part of a golf ball 15 according to yet another embodiment of the present invention; and FIG. 6 (*b*) is a cross-sectional view of the same. In this FIG. 6 (*b*), a cross-section is illustrated which is provided by a plane that passes the center of gravity of the plane shape of the dimple 16 and the center of the golf ball 15. This golf ball 15 also has a core and a cover which are similar to those of the golf ball 1 depicted in FIG. 1. As shown in the FIG. 6, the dimple 16 includes an inclined face 17, a first circular flat face 18, an annular groove 19, a second circular flat face 20 and a recessed part 21. The surface area s1 is calculated by summing up the surface area of the inclined face 17, the surface area of the first circular flat face 18, the surface area of the annular groove 19, the surface area of the second circular flat face 20 and the surface area of the recessed part 21. The surface area S1 is obtained by summing up the surface areas s1 of all the dimples.

What is indicated by a chain double-dashed line in FIG. 6 (*b*) is a region that was cut away by the dimple 15 from the phantom spherical face. The area of this region is s2. The total area S2 is obtained by summing up the areas s2 for all the dimples.

According to the dimple 16, the surface area s1 thereof is increased because of the annular groove 19 and the recessed part 21. Also in the golf ball 15, the ratio (S1/S2) is equal to or greater than 1.03. The golf ball 15 is excellent in flight performance. The ratio (S1/S2) is more preferably equal to or greater than 1.06, and particularly, preferably equal to or greater than 1.09. The ratio (S1/S2) is preferably equal to or less than 1.50.

Also in this golf ball 15, the total volume V is set to be 400 $mm^3$ or greater and 800 $mm^3$ or less. The total volume V is more preferably equal to or greater than 420 $mm^3$, and particularly, preferably equal to or greater than 440 $mm^3$. The total volume V is more preferably equal to or less than 760 $mm^3$, and particularly, preferably equal to or less than 720 $mm^3$. Through the formation of a large number of dimples 15 having the annular groove 19 or the recessed part 21, a golf ball can be obtained having the total volume V of within a proper range, with the ratio (S1/S2) being equal to or greater than 1.03. Also in the golf ball 15, the surface area occupation ratio Y is preferably 70% or greater and 90% or less. The surface area occupation ratio Y is more preferably equal to or greater than 72%, and particularly, preferably equal to or greater than 75%. The surface area occupation ratio Y is more preferably equal to or less than 88%, and particularly, preferably equal to or less than 87%. Also, in the golf ball 15, the total number N of the dimples is preferably 200 or greater and 500 or less. The total number N is more preferably equal to or greater than 230, and particularly, preferably equal to or greater than 250. The total number N is more preferably equal to or less than 470, and particularly, preferably equal to or less than 450.

The shore D hardness of the cover of the golf ball 15 is set to be equal to or less than 53. The shore D hardness of the cover is preferably equal to or less than 50, and particularly, preferably equal to or less than 45. The shore D hardness of the cover is preferably equal to or greater than 25, and particularly, preferably equal to or greater than 30. The thickness of the cover is set to be equal to or less than 1.4 mm. The thickness of the cover is preferably equal to or less than 1.2 mm, and particularly, preferably equal to or less than 1.0 mm. The thickness of the cover is preferably equal to or greater than 0.3 mm, and particularly, preferably equal to or greater than 0.5 mm.

Difference (Cc−Cb) between the amount of compressive deformation Cb of the golf ball 15 and the amount of compressive deformation Cc of the core is preferably equal to or less than 0.20 mm. The difference (Cc−Cb) is preferably equal to or less than 0.15 mm, and particularly, preferably equal to or less than 0.10 mm. The difference (Cc−Cb) is preferably equal to or greater than −0.20 mm, and particularly, preferably equal to or greater than −0.15 mm.

The amount of compressive deformation Cc of the core is preferably equal to or less than 3.00 mm. The amount of compressive deformation Cc is preferably equal to or less than 2.80 mm, more preferably equal to or less than 2.50 mm, still more preferably equal to or less than 2.45 mm, and further more preferably equal to or less than 2.40 mm. The amount of compressive deformation Cc is preferably equal to or greater than 2.00 mm.

The amount of compressive deformation Cb of the golf ball 15 is preferably equal to or less than 3.00 mm. The amount of compressive deformation Cb is preferably equal to or less than 2.80 mm, more preferably equal to or less than 2.60 mm, and further more preferably equal to or less than 2.40 mm. The amount of compressive deformation Cb is preferably equal to or greater than 1.80 mm, and particularly, preferably equal to or greater than 2.00 mm.

A variety of dimples such as dimples having an annular groove (the type as illustrated in FIG. 4), dimples having a recessed part (the type as illustrated in FIG. 5) dimples having an annular groove and a recessed part (the type as illustrated in FIG. 6) and the like may be present admixed on a single golf ball. In stead of these dimples, or together with one or two or more types of these dimples, a dimple having an elevated surface area s1 on behalf of a protrusion may be formed. Examples of the shape of the protrusion include annular, spherical, conical, truncated conical, pyramidal, truncated pyramidal, cylindrical, prismatic and the like.

EXAMPLES

Although the present invention will be described below specifically on the basis of examples, the invention is not limited to the examples.

Example 1

A rubber composition was obtained by kneading 100 parts by weight of polybutadiene (trade name "BR-11", available from JSR Corporation), 30 parts by weight of zinc acrylate, 10 parts by weight of zinc oxide, an appropriate amount of barium sulfate and 0.8 part by weight of dicumyl peroxide. This rubber composition was placed into a mold having upper and lower half both having a hemispherical cavity, and heated at 160° C. for 25 minutes to obtain a core having the diameter of 40.7 mm. On the other hand, 100 parts by weight of a thermoplastic polyurethane elastomer and 3 parts by weight of titanium dioxide were kneaded to give a resin composition. The core as described above was placed into a mold having numerous protrusions on its inside surface, and the aforementioned resin composition was injected around the core to form a cover having the thickness of 1.0 mm. On the cover were formed numerous dimples having the shape that is an inverted shape of the protrusion. Paint was applied over this cover, and thus a golf ball of Example 1 having the diameter of 42.7 mm was obtained. Specifications of this golf ball are as listed in "type II" shown in Table 1 below. All the dimples in the dimple pattern of type II have a recessed part at the center thereof.

Comparative Example 1 and Examples 2 to 3

Figure 7:
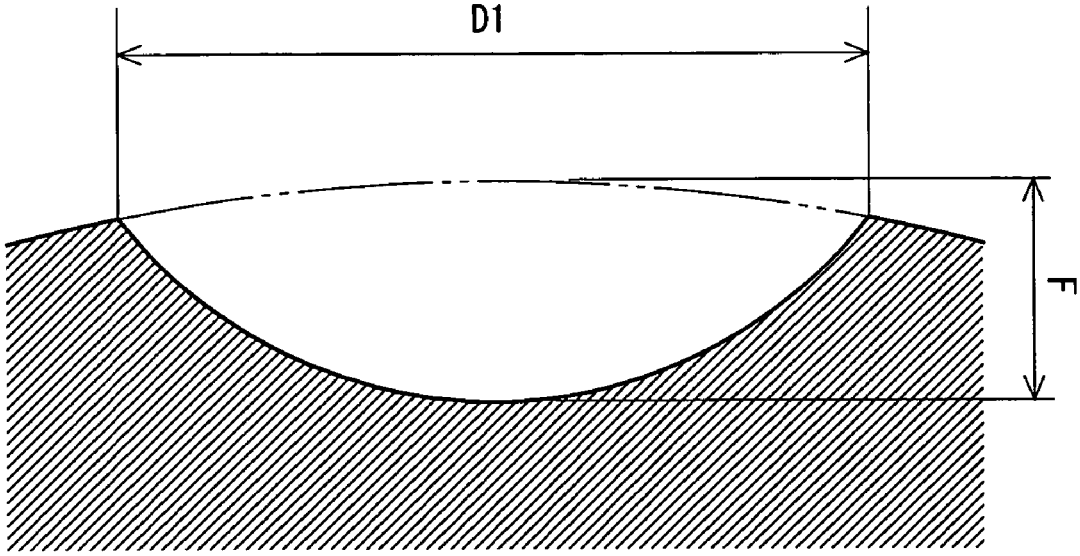
FIG. 7 is a cross-sectional view illustrating a part of a golf ball according to Comparative Examples 1.

In a similar manner to Example 1 except that specifications of the dimples were altered as presented in Table 4 below by changing the mold, golf balls of Comparative Example 1 and Examples 2 to 3 were obtained. Detailed specifications of the dimples are shown in Table 1 below. All the dimples in the dimple pattern of type I have a cross-sectional shape of a circular arc as depicted in FIG. 7. All the dimples in the dimple pattern of type III have an annular groove. All the dimples in the dimple pattern of type IV have a recessed part and an annular groove.

Example 4 and Comparative Examples 2 to 3

In a similar manner to Example 1 except that the type of the core, the type of the cover or the specification of the dimples was altered as presented in Table 4 below, golf balls of Example 4 and Comparative Examples 2 to 3 were obtained. Details of the composition of the core are shown in Table 2 below. Details of the composition of the cover are shown in Table 3 below.

TABLE 1

| | | Specification of Dimple | | | | | | | |
|---|---|---|---|---|---|---|---|---|---|
| Type | Kind | Diameter D1 (mm) | Distance D2 (mm) | Height h (mm) | Curvature r (mm) | Distance a (mm) | Distance b (mm) | Depth F (mm) | Surface area s1 ($mm^2$) |
| I | A | 4.000 | — | — | — | — | — | 0.2539 | 12.65 |
| | B | 3.450 | — | — | — | — | — | 0.2248 | 9.42 |
| | C | 3.300 | — | — | — | — | — | 0.2189 | 8.63 |
| | D | 3.150 | — | — | — | — | — | 0.2132 | 7.87 |

TABLE 1-continued

| | | | | | | | | | |
|---|---|---|---|---|---|---|---|---|---|
| II | A | 4.000 | 2.200 | 0.310 | 1.80 | — | — | 0.4539 | 12.88 |
| | B | 3.450 | 2.000 | 0.310 | 1.70 | — | — | 0.4298 | 9.66 |
| | C | 3.300 | 2.000 | 0.310 | 1.55 | — | — | 0.4239 | 8.87 |
| | D | 3.150 | 1.800 | 0.305 | 1.45 | — | — | 0.4132 | 8.10 |
| III | A | 4.000 | 2.200 | 0.075 | — | 0.700 | 1.000 | 0.2779 | 13.43 |
| | B | 3.450 | 2.000 | 0.075 | — | 0.700 | 0.975 | 0.2528 | 10.21 |
| | C | 3.300 | 2.000 | 0.075 | — | 0.700 | 0.900 | 0.2469 | 9.38 |
| | D | 3.150 | 1.800 | 0.075 | — | 0.700 | 0.900 | 0.2412 | 8.61 |
| IV | A | 4.000 | 2.200 | 0.150 | 1.10 | 0.500 | 0.750 | 0.3339 | 13.86 |
| | B | 3.450 | 2.000 | 0.150 | 1.10 | 0.500 | 0.750 | 0.3098 | 10.64 |
| | C | 3.300 | 2.000 | 0.140 | 1.10 | 0.400 | 0.700 | 0.2939 | 9.63 |
| | D | 3.150 | 1.800 | 0.140 | 1.10 | 0.400 | 0.700 | 0.2882 | 8.87 |

| | | Area | Volume | Total area | | | Total volume | Occupation ratio | Plan view |
|---|---|---|---|---|---|---|---|---|---|
| Type | Kind | s2 ($mm^2$) | v ($mm^3$) | S1 ($mm^2$) | S2 ($mm^2$) | S1/S2 | V ($mm^3$) | Y (%) | Front view Enlarged view |
| I | A | 12.59 | 1.598 | 4355.5 | 4330.0 | 1.006 | 506.7 | 75.6 | FIG. 2 |
| | B | 9.36 | 1.053 | | | | | | FIG. 3 |
| | C | 8.57 | 0.938 | | | | | | FIG. 7 |
| | D | 7.80 | 0.833 | | | | | | |
| II | A | 12.59 | 1.491 | 4458.3 | 4330.0 | 1.030 | 507.5 | 75.6 | FIG. 2 |
| | B | 9.36 | 1.107 | | | | | | FIG. 3 |
| | C | 8.57 | 0.918 | | | | | | FIG. 5 |
| | D | 7.80 | 0.867 | | | | | | |
| III | A | 12.59 | 1.556 | 4689.7 | 4330.0 | 1.083 | 507.2 | 75.6 | FIG. 2 |
| | B | 9.36 | 1.080 | | | | | | FIG. 3 |
| | C | 8.57 | 0.956 | | | | | | FIG. 4 |
| | D | 7.80 | 0.835 | | | | | | |
| IV | A | 12.59 | 1.510 | 4855.6 | 4330.0 | 1.121 | 506.9 | 75.6 | FIG. 2 |
| | B | 9.36 | 1.085 | | | | | | FIG. 3 |
| | C | 8.57 | 0.990 | | | | | | FIG. 6 |
| | D | 7.80 | 0.881 | | | | | | |

TABLE 2

Composition of core (parts by weight)

| Type | x | y | z |
|---|---|---|---|
| Polybutadiene | 100 | 100 | 100 |
| Zinc acrylate | 34 | 35.5 | 33 |
| Zinc oxide | 10 | 10 | 10 |
| Barium sulfate * | appropriate amount | appropriate amount | appropriate amount |
| Dicumyl peroxide | 0.8 | 0.8 | 0.8 |

* Adjusted to give the weight of the golf ball to be 45.4 g

TABLE 3

Composition of cover (parts by weight)

| Type | a | b | c |
|---|---|---|---|
| Ionomer resin 1555 *1 | — | — | 35 |
| Ionomer resin 1557 *2 | — | — | 35 |
| Thermoplastic styrene elastomer *3 | — | — | 30 |
| Thermoplastic polyurethane elastomer 97A *4 | 100 | — | — |
| Thermoplastic polyurethane elastomer 90A *5 | — | 100 | — |
| Titanium dioxide | 3 | 3 | 3 |

*1 "Himilan 1555", trade name by Du Pont-MITSUI POLYCHEMICALS Co., Ltd.
*2 "Himilan 1557", trade name by Du Pont-MITSUI POLYCHEMICALS Co., Ltd.
*3 "Rabalon SR04", trade name by Mitsubishi Chemical Corporation TABLE 3-continued Composition of cover (parts by weight)

| Type | a | b | c |
|---|---|---|---|

*4 "Elastolan XNY97A", trade name by BASF Polyurethane Elastomers Co., Ltd.
*5 "Elastolan XNY90A", trade name by BASF Polyurethane Elastomers Co., Ltd.

[Measurement of Resilience Coefficient]

To the golf ball was impacted a hollow cylinder made of aluminum of which weight being 200 g at a velocity of 45 m/s. Then, velocity of the hollow cylinder prior to and after the impact, and the velocity of the golf ball after the impact were measured to determine the resilience coefficient of the golf ball. Mean values of data which resulted from 12 times measurement are shown in Table 4 below as indices on the basis of the resilience coefficient of the golf ball of Comparative Example 1 which was converted to be 1.00.

Travel Distance Test

A driver with a metal head (Sumitomo Rubber Industries, Ltd., trade name "XXIO", shaft type: S, loft angle: 10°) was equipped with a swing machine manufactured by True Temper Co. Then the machine was conditioned to give the head speed of 45 m/sec, and the golf ball was hit therewith. Accordingly, travel distance (i.e., the distance from the launching point to the point where the ball stopped) was measured. Mean values of 5 times measurement are shown in Table 4 below.

TABLE 4

| | | Results of evaluation | | | | | | |
|---|---|---|---|---|---|---|---|---|
| | | Comp. Example 1 | Example 1 | Example 2 | Example 3 | Example 4 | Comp. Example 2 | Comp. Example 3 |
| Core | Type | x | x | x | x | y | z | x |
| | Diameter (mm) | 40.7 | 40.7 | 40.7 | 40.7 | 40.7 | 39.5 | 40.7 |
| | Amount of compressive deformation Cc (mm) | 2.40 | 2.40 | 2.40 | 2.40 | 2.20 | 2.50 | 2.40 |
| Cover | Type | a | a | a | a | b | a | c |
| | Thickness (mm) | 1.0 | 1.0 | 1.0 | 1.0 | 1.0 | 1.6 | 1.0 |
| | Hardness (Shore D) | 49 | 49 | 49 | 49 | 47 | 49 | 55 |
| Dimple | Type | I | II | III | IV | IV | II | II |
| | S1/S2 | 1.006 | 1.030 | 1.083 | 1.121 | 1.121 | 1.030 | 1.030 |
| Amount of compressive deformation Cb of ball (mm) | | 2.25 | 2.25 | 2.25 | 2.25 | 2.15 | 2.30 | 2.10 |
| Cc-Cb (mm) | | 0.15 | 0.15 | 0.15 | 0.15 | 0.05 | 0.20 | 0.30 |
| Resilience performance (index) | | 1.00 11 | 1.00 | 1.00 | 1.00 | 1.02 | 0.98 | 1.01 |
| Travel distance (m) | | 216.0 | 218.0 | 219.0 | 219.5 | 220.0 | 215.0 | 216.0 |

As is clear from Table 4, the golf ball of each of Examples is excellent in flight performance. Therefore, advantages of the present invention are clearly indicated by these results of evaluation.

The description herein above is just for an illustrative example, therefore, and various modifications can be made without departing from the principles of the present invention.

What is claimed is:

1. A golf ball having a diameter of from 40 mm to 45 mm which comprises a core, a cover and numerous dimples formed on the surface of the cover, in an amount of at least 200 to 500 or less said dimples having an annular groove, wherein the thickness of the cover is equal to or less than 1.4 mm, the shore D hardness of the cover is equal to or less than 53, and the ratio (S1/S2) between a summation S1 of surface areas s1 of the dimples, and a summation S2 of the areas s2 of the regions cut away by the dimples from a phantom spherical face is equal to or greater than 1.03, wherein the surface area s1 is from 8.2 $mm^2$ to 38.7 $mm^2$ and the total surface area S1 is 4130 $mm^2$ to 7740 $mm^2$.

2. The golf ball according to claim 1 wherein the difference (Cc−Cb) between the amount of compressive deformation Cb of the golf ball and the amount of compressive deformation Cc of the core is equal to or less than 0.20 mm, and the amount of compressive deformation Cc of the core is equal to or less than 3.00 mm.

3. The golf ball according to claim 1 wherein total volume V of said the dimples is 400 mm3 or greater and 800 mm3 or less.

4. The golf ball according to claim 1 wherein the dimples have a recessed part at the center thereof.

5. The golf ball according to claim 1, wherein the depth of the dimple is from 0.10 mm to 2.0 mm.

6. The golf ball according to claim 1, wherein the number of dimples which have a ratio (S1/S2) equal to or greater than 1.03 is at least 50% of the total number of dimples.

7. The golf ball according to claim 1, wherein the surface are s2 is from 8.0 mm2 to 25.8 mm2 and the total surface area S2 is 4010 mm2 to 5160 mm2.

8. The golf ball according to claim 1, wherein the occupation ratio which the dimples occupy on the surface of the golf ball is from 70 to 90%.

* * * * *